US010352137B1

(12) United States Patent
Chen et al.

(10) Patent No.: US 10,352,137 B1
(45) Date of Patent: Jul. 16, 2019

(54) REMOVING LIQUID BY SUBSURFACE COMPRESSION SYSTEM

(71) Applicant: Upwing Energy, LLC, Cerritos, CA (US)

(72) Inventors: Kuo-Chiang Chen, Kennedale, TX (US); Herman Artinian, Huntington Beach, CA (US); David Biddick, Houston, TX (US); Lukasz Nader, Cerritos, CA (US); Christopher Matthew Sellers, Fullerton, CA (US)

(73) Assignee: Upwing Energy, LLC, Cerritos, CA (US)

( * ) Notice: Subject to any disclaimer, the term of this patent is extended or adjusted under 35 U.S.C. 154(b) by 0 days.

(21) Appl. No.: 16/241,673

(22) Filed: Jan. 7, 2019

(51) Int. Cl.
*E21B 43/12* (2006.01)
*E21B 43/14* (2006.01)
*E21B 34/08* (2006.01)

(52) U.S. Cl.
CPC ..... *E21B 43/12* (2013.01); *E21B 34/08* (2013.01)

(58) Field of Classification Search
CPC ..... E21B 43/121; E21B 43/128; E21B 43/14
See application file for complete search history.

(56) References Cited

U.S. PATENT DOCUMENTS

2006/0157251 A1* 7/2006 Stinessen ..... F04D 25/0606 166/357
2011/0011580 A1* 1/2011 Clark ..... E21B 33/124 166/244.1
2011/0024123 A1* 2/2011 Brown ..... E21B 43/128 166/369
2016/0273315 A1* 9/2016 Carvajal ..... E21B 43/00

OTHER PUBLICATIONS

Youtube [online], Calnetix Technologies, "Upwing Subsurface Compressor System Overview," Youtube video, Mar. 16, 2017, [retrieved on Apr. 1, 2019], retrieved from: URL<https://www.youtube.com/watch?v=aE13zsGzEMI>, 10 pages (Video Submission with English Transcript).

* cited by examiner

*Primary Examiner* — Cathleen R Hutchins
(74) *Attorney, Agent, or Firm* — Fish & Richardson P.C.

(57) ABSTRACT

A gas flow velocity within a horizontal wellbore section is increased by a velocity string and a downhole-type compressor. A pressure within the horizontal wellbore section is decreased by a downhole-type compressor located within a vertical wellbore section fluidically connected to the horizontal wellbore section. Liquid build-up within the horizontal wellbore section is decreased in response to the increased gas flow velocity and the decreased pressure.

23 Claims, 5 Drawing Sheets

REMOVING LIQUID BY SUBSURFACE COMPRESSION SYSTEM

TECHNICAL FIELD

This disclosure relates to hydrocarbon production within a wellbore.

BACKGROUND

Most wells behave characteristically different over time due to geophysical, physical, and chemical changes in the subterranean reservoir that feeds the well. For example, it is common for well production to decline. This decline in production can occur due to declining pressures in the reservoir, and can eventually reach a point where there is not enough pressure in the reservoir to economically realize production through the well to the surface. Alternatively or in addition, liquid production can increase or decrease. As production parameters of the well change, additional equipment can be added to maintain production. For example, a top side compressor and/or pump are sometimes used to extend the life of the well by decreasing pressure at the top of the well.

SUMMARY

This disclosure relates to removing liquids from a horizontal wellbore with a subsurface compression system.

An example implementation of the subject matter described within this disclosure is a well production method with the following features. A gas flow velocity within a horizontal wellbore section is increased by a velocity string and a downhole-type compressor. A pressure within the horizontal wellbore section is decreased by a downhole-type compressor located within a wellbore section fluidically connected to the horizontal wellbore section. Liquid build-up within the horizontal wellbore section is decreased in response to the increased gas flow velocity and the decreased pressure.

Aspects of the example implementation, which can be combined with the example implementation alone or in combination, include the following. A temperature of the gas flow is increased by the downhole-type compressor.

Aspects of the example implementation, which can be combined with the example implementation alone or in combination, include the following. The increased temperature is sufficient to prevent liquid fallout between a discharge of the downhole-type compressor and a topside facility located at an uphole end of the vertical wellbore section.

Aspects of the example implementation, which can be combined with the example implementation alone or in combination, include the following. The downhole-type compressor sized to set a minimum flow velocity to remove liquids from the horizontal wellbore section.

Aspects of the example implementation, which can be combined with the example implementation alone or in combination, include the following. The downhole-type compressor is sized to set a maximum downhole pressure to vaporize liquids in the horizontal wellbore section.

Aspects of the example implementation, which can be combined with the example implementation alone or in combination, include the following. The downhole-type compressor is sized to use a specified amount of power to drive the compressor.

Aspects of the example implementation, which can be combined with the example implementation alone or in combination, include the following. The velocity string is an active velocity string. The method further includes adjusting a cross-sectional flow area of the active velocity string to adjust the gas velocity of the horizontal wellbore during a gas production operation.

Aspects of the example implementation, which can be combined with the example implementation alone or in combination, include the following. The inflow control device is a first inflow control device, and the horizontal wellbore section is a first horizontal wellbore section, the method further includes increasing a gas flow velocity within a second horizontal wellbore section by a second velocity string and the downhole-type compressor.

Aspects of the example implementation, which can be combined with the example implementation alone or in combination, include the following. A gas flow velocity is increased within a third horizontal wellbore section by a third velocity string and the downhole-type compressor.

An example implementation of the subject matter described within this disclosure is a wellbore production system with the following features. A production wellbore includes a vertical portion and a horizontal portion. The vertical portion includes a first end at a topside facility. The horizontal portion includes a first end connected to a second end of the vertical portion, and a second end at a distal end of the production wellbore. A downhole-type compressor is located within the wellbore. The downhole-type compressor is configured to decrease a pressure on a downhole side of the compressor and increase a pressure on an uphole side of the compressor. The decreased pressure on the downhole side is sufficient to at least partially vaporize liquids within the horizontal portion. The increased pressure on the uphole side is sufficient to flow gas from a compressor discharge to the topside facility. A production string is located at least partially within the horizontal portion. A velocity string is located within the horizontal portion of the wellbore. The velocity string is fluidically connected to the production string. The velocity string is configured to adjust a gas velocity within the horizontal portion of the wellbore.

Aspects of the example implementation, which can be combined with the example implementation alone or in combination, include the following. The velocity string includes a flow passage with a cross-sectional flow area that is less than the cross-sectional flow area of the production string.

Aspects of the example implementation, which can be combined with the example implementation alone or in combination, include the following. The velocity string is a first velocity string. The first velocity string is located adjacent to a first production zone. The wellbore production system further includes a first set of packers including a first packer located on a first end of the first velocity string and a second packer located on a second end of the first velocity string. The first packer and the second packer are configured to fluidically isolate an annulus, defined by the first velocity string and a wall of the horizontal portion adjacent to the first production zone, from a remainder of the wellbore. A second velocity string is fluidically connected to the production string. The second velocity string is adjacent to a second production zone.

Aspects of the example implementation, which can be combined with the example implementation alone or in combination, include the following. A third packer is located on a second end of the second velocity string. The second packer and the third packer are configured to fluidically isolate an annulus, defined by the second velocity string and a wall of the horizontal portion adjacent to the second production zone, from a remainder of the wellbore. A third velocity string is fluidically connected to the production string. The third velocity string is positioned on a side of the third packer opposite of the second velocity string. The third velocity string is adjacent to a third production zone.

Aspects of the example implementation, which can be combined with the example implementation alone or in combination, include the following. A surface compressor is fluidically connected to an uphole end of the production tubing. The surface compressor is configured to further increase the gas flow velocity.

Aspects of the example implementation, which can be combined with the example implementation alone or in combination, include the following. The surface compressor includes a subsea compressor.

Aspects of the example implementation, which can be combined with the example implementation alone or in combination, include the following. The horizontal portion is a first horizontal portion, and the velocity string is a first velocity string. The system further includes a second horizontal portion with a first end connected to the second end of the vertical portion and a second end at a second distal end of the production wellbore. A second velocity string is located within the second horizontal portion of the wellbore. The second velocity string is fluidically connected to the production string. The second velocity string is configured to adjust a gas velocity within the horizontal portion of the wellbore.

An example implementation of the subject matter described within this disclosure is a well production method with the following features. A gas flow velocity within a horizontal wellbore section is increased by a velocity string and a downhole-type compressor. A pressure within the horizontal wellbore section is decreased by a downhole-type compressor located within a vertical wellbore section fluidically connected to the horizontal wellbore section. Liquid build-up within the horizontal wellbore section is decreased in response to the increased gas flow velocity and the decreased pressure. A temperature of the gas flow is increased by the downhole-type compressor. The increased temperature is sufficient to prevent liquid fallout between a discharge of the downhole-type compressor and a topside facility located at an uphole end of the vertical wellbore section.

Aspects of the example implementation, which can be combined with the example implementation alone or in combination, include the following. The downhole-type compressor is sized to set a minimum flow velocity to remove liquids from the horizontal section.

Aspects of the example implementation, which can be combined with the example implementation alone or in combination, include the following. The downhole-type compressor is sized to set a maximum downhole pressure to vaporize liquids in the horizontal section.

Aspects of the example implementation, which can be combined with the example implementation alone or in combination, include the following. The downhole-type compressor is sized to use a specified an amount of power to drive the compressor.

Aspects of the example implementation, which can be combined with the example implementation alone or in combination, include the following. The velocity string is an active velocity string. The method further includes adjusting a cross-sectional flow area of the active velocity string to adjust the gas velocity of the horizontal wellbore during a gas production operation.

Aspects of the example implementation, which can be combined with the example implementation alone or in combination, include the following. The velocity string is a first velocity string, and the horizontal wellbore section is a first horizontal wellbore section. The method further includes increasing a gas flow velocity within a second horizontal wellbore section by a second velocity string and the downhole-type compressor.

Aspects of the example implementation, which can be combined with the example implementation alone or in combination, include the following. The second velocity string is an active velocity string. The method further includes adjusting a cross-sectional flow area of the active velocity string to adjust the gas velocity of the second horizontal wellbore section during a gas production operation.

Aspects of the example implementation, which can be combined with the example implementation alone or in combination, include the following. A gas flow velocity within a third horizontal wellbore section is increased by a third velocity string and the downhole-type compressor.

The details of one or more embodiments of the invention are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

As gas production wells age, they can begin producing liquids. The liquid production can include water, condensate, or any other production fluid. In horizontal and deviated wellbores, the liquid can pool and create sufficient static head to reduce gas production. A gas production well is often referred to as "liquid loaded" when such an event occurs. When the gas well is liquid loaded, a back pressure generated by liquids will reduce gas production. This, in turn, reduces production gas velocity, as there is less of a gas mass flow rate. The reduced gas velocity also reduces liquid sweeping, and lets more liquid remain within the gas well. Such a vicious cycle can reduce a production rate of a gas production well.

This disclosure describes removing liquids from vertical and horizontal sections of gas wells by installing a downhole-type compressor, or subsurface compression system (SCS), with other completion hardware, such as a velocity string or an Inflow Control Device (ICD) at the intake side of the SCS in a gas or condensate well. By removing the liquids from gas and condensate wells, the production of the well will increase due to the removal of the blockage generated by liquids either in the wellbore or in the pore space of the formation rocks. Without removing the liquids, gas in the formation and in the wellbore will have to work against the viscous forces and hydrostatic column formed by the accumulated liquids in the wellbore to reach the surface. When the viscous and hydrostatic forces increase and change the flow behavior and fluid distribution, or back pressure and liquid hold up are high enough, the gas production will decrease to the point that the well stops producing.

Figure 1:
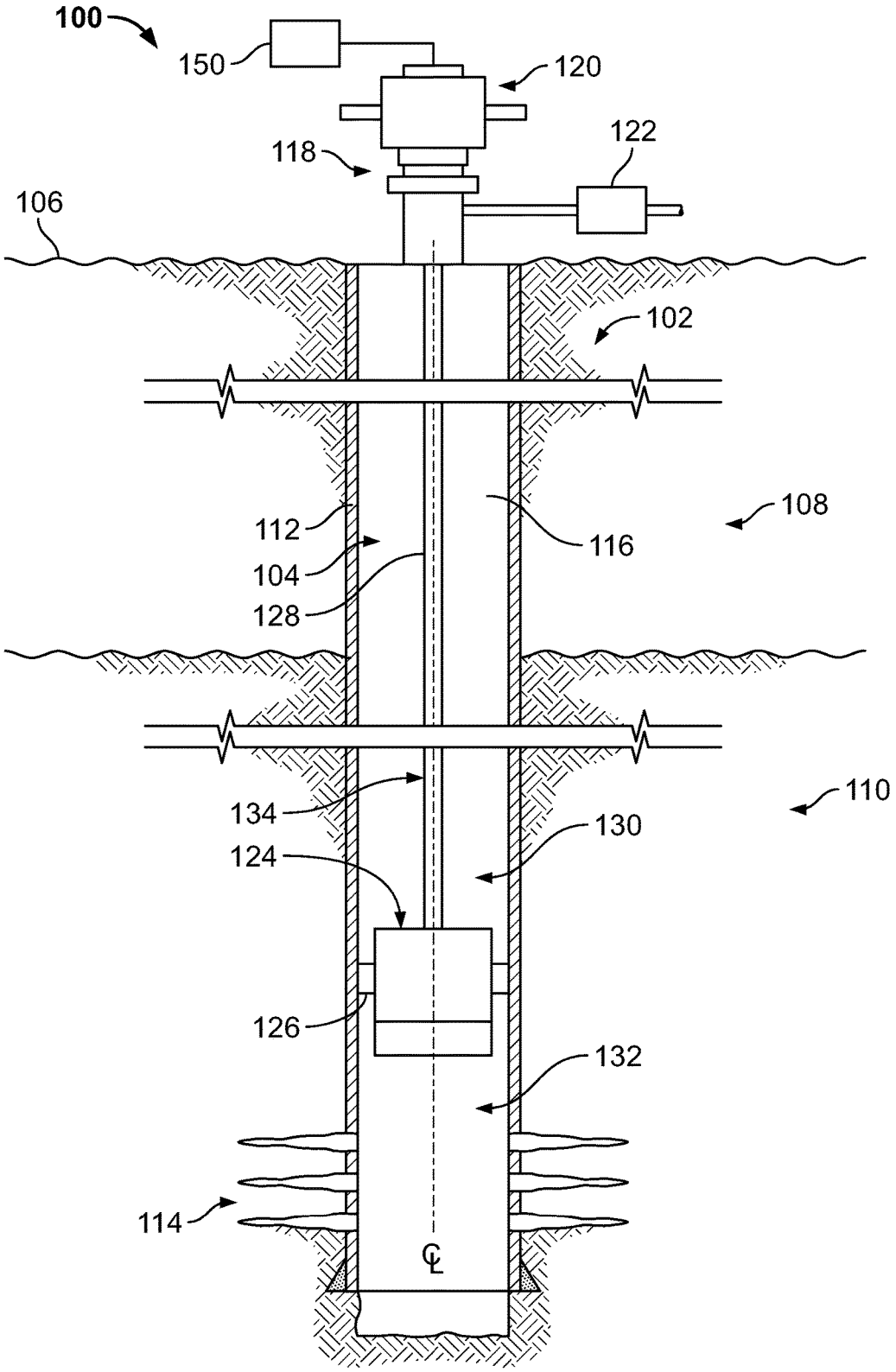
FIG. 1 is a side cross-sectional view of a first example wellbore production system.

FIG. 1 depicts an example production well system 100 constructed in accordance with the concepts herein. The production well system 100 includes a well 102 having a wellbore 104 that extends from the terranean surface 106 through the earth 108 to one or more production zones, or subterranean zones of interest 110 (one shown). The production well system 100 enables access to the subterranean zones of interest 110 to allow recovery, i.e., production, of fluids to the terranean surface 106 and, in certain instances, additionally or alternatively allows fluids to be placed in the earth 108. In certain instances, the subterranean zones of interest 110 is a formation within the Earth defining a reservoir, but in other instances, the subterranean zones of interest 110 can be multiple formations or a portion of a formation. For the sake of simplicity, the well 102 is shown as a vertical well with a vertical wellbore 104, but in other instances, the well 102 could be a deviated well with the wellbore 104 deviated from vertical (e.g., horizontal or slanted) and/or the wellbore 104 could be one of the multiple bores of a multilateral well (i.e., a well having multiple lateral wells branching off another well or wells).

In certain instances, the production well system 100 is a well that is used in producing hydrocarbon production fluid from the subterranean zones of interest 110 to the terranean surface 106. The well may be primarily a gas well. That is, a majority of the production fluid is a gas. Though it may be primarily a gas well, the well may produce only dry gas, liquid hydrocarbons, and/or water. In certain instances, the production from the well 102 can be multiphase in any ratio. The well can produce mostly or entirely liquid at certain times and mostly or entirely gas at other times. For example, in certain types of wells, it is common to produce water for a period of time to gain access to the gas in the subterranean zone. The concepts herein, though, are not limited in applicability to gas wells or even production wells, and could be used in wells for producing liquid resources such as oil, water, or other liquid resources.

The wellbore 104 is typically, although not necessarily, cylindrical. All or a portion of the wellbore 104 is lined with a tubing, i.e., casing 112. The casing 112 connects with a wellhead 118 at the terranean surface 106 and extends downhole into the wellbore 104. The casing 112 operates to isolate the bore of the well 102, defined in the cased portion of the well 102 by the inner bore 116 of the casing 112, from the surrounding earth 108. The casing 112 can be formed of single continuous tubing or multiple lengths of tubing joined (e.g., threaded and/or otherwise) end-to-end. In FIG. 1, the casing 112 is perforated (i.e., having perforations 114) in the subterranean zone of interest 110 to allow fluid communication between the subterranean zone of interest 110 and the inner bore 116 of the casing 112. In other instances, the casing 112 is omitted or ceases in the region of the subterranean zone of interest 110. This portion of the wellbore 104 without casing is often referred to as "open hole."

The wellhead 118 defines an attachment point for other equipment of the production well system 100 to be attached to the well 102. For example, FIG. 1 shows well 102 being produced with a Christmas tree 120 attached to the wellhead 118. The Christmas tree 120 includes valves used to regulate flow into or out of the well 102.

FIG. 1 shows a surface compressor 122 residing on the terranean surface 106 and fluidly coupled to the well 102 through the Christmas tree 120. The surface compressor 122 can include a variable speed or fixed speed compressor. The production well system 100 also includes a subsurface compressor system (SCS) 124 residing in the wellbore 104, for example, at a depth that is nearer to subterranean zone of interest 110 than the terranean surface 106. The surface compressor 122 operates to draw down the pressure inside the well 102 at the terranean surface 106 to facilitate production of fluids to the terranean surface 106 and out of the well 102. The SCS 124, being of a type configured in size and robust construction for installation within a well 102, assists by creating an additional pressure differential within the well 102. In particular, casing 112 is commercially produced in a number of common sizes specified by the American Petroleum Institute (the "API"), including 4-1/2, 5, 5-1/2, 6, 6-5/8, 7, 7-5/8, 16/8, 9-5/8, 10-3/4, 11-3/4, 13-3/8, 16, 18-5/8 and 20 inches, and the API specifies internal diameters for each casing size. In some implementations, the casing 112 can be produced in a non-standard size. The SCS 124 can be configured to fit in and, (as discussed in more detail below) in certain instances, seal to the inner diameter of one of the specified API casing sizes. Of course, the SCS 124 can be made to fit in and, in certain instances, seal to other sizes of casing or tubing or otherwise seal to the wall of the wellbore 104.

Additionally, as an SCS 124 or any other downhole system configuration such as a pump, compressor, or multiphase fluid flow aid that can be envisioned, the construction of its components is configured to withstand the impacts, scraping, and other physical challenges that the SCS 124 will encounter while being passed hundreds of feet/meters or even multiple miles/kilometers into and out of the wellbore 104. For example, the SCS 124 can be disposed in the wellbore 104 at a depth of up to 15,000 feet (4,572 meters). Beyond just a rugged exterior, this encompasses having certain portions of any electronics be ruggedized to be shock resistant and remain fluid tight during such physical challenges and during operation. Additionally, the SCS 124 is configured to withstand and operate for extended periods of time (e.g., multiple weeks, months, or years) at the pressures and temperatures experienced in the wellbore 104, temperatures which can exceed 400° F. / 205° C. and pressures of over 2,000 pounds per square inch, and while submerged in the well fluids (gas, water, or oil as examples). Finally, as a downhole-type artificial lift system, the SCS 124 can be configured to interface with one or more of the common deployment systems, such as jointed tubing (i.e., lengths of tubing joined end-to-end, threaded and/or otherwise), a sucker rod, coiled tubing (i.e., not-jointed tubing, but rather a continuous, unbroken and flexible tubing formed as a single piece of material), or wireline with an electrical conductor (i.e., a monofilament or multifilament wire rope with one or more electrical conductors, sometimes called e-line) and thus have a corresponding connector (e.g., coupling 220 discussed below, which can be a jointed tubing connector, coiled tubing connector, or wireline connector). In FIG. 1, the SCS 124 is shown deployed on wireline 128.

A seal system 126 integrated or provided separately with a downhole system, as shown with the SCS 124, divides the well 102 into an uphole zone 130 above the seal system 126 and a downhole zone 132 below the seal system 126. FIG. 1 shows the SCS 124 positioned in the open volume of the inner bore 116 of the casing 112, and not within or a part of another string of tubing in the well 102. The wall of the wellbore 104 includes the interior wall of the casing 112 in portions of the wellbore 104 having the casing 112, and includes the open-hole wellbore wall in uncased portions of the wellbore 104. Thus, the seal system 126 is configured to seal against the wall of the wellbore 104, for example, against the interior wall of the casing 112 in the cased portions of the wellbore 104 or against the interior wall of the wellbore 104 in the uncased, open-hole portions of the wellbore 104. In certain instances, the seal system 126 can form a gas and liquid tight seal at the pressure differential that the SCS 124 creates in the well 102. In some instances, the seal system 126 of the SCS 124 seals against the interior wall of the casing 112 or the open-hole portion of the wellbore 104. For example, the seal system 126 can be configured to at least partially seal against an interior wall of the wellbore 104 to separate (completely or substantially) a pressure in the wellbore 104 downhole of the seal system 126 of the SCS 124 from a pressure in the wellbore 104 uphole of the seal system 126 of the SCS 124. Although FIG. 1 includes both the surface compressor 122 and the SCS 124, in other instances, the surface compressor 122 can be omitted and the SCS 124 can provide the entire pressure boost in the well 102. While illustrated with the seal system 126, such a seal system can be eliminated in some instances. For example, when a packer and production tubing are used with the SCS124.

In some implementations, the SCS 124 can be implemented to alter characteristics of a wellbore by a mechanical intervention at the source. Alternatively or in addition to any of the other implementations described in this specification, the SCS 124 can be implemented as a high flow, low pressure rotary device for gas flow in sub-atmospheric wells. Alternatively or in addition to any of the other implementations described in this specification, the SCS 124 can be implemented as a high pressure, low flow rotary device for gas flow in sub-atmospheric wells. Alternatively or in addition to any of the other implementations described in this specification, the SCS 124 can be implemented in a direct well-casing deployment for production through the wellbore. While the SCS 124 is described in detail as an example implementation of the downhole system, alternative implementations of the downhole system as a pump, compressor, or multiphase combination of these can be utilized in the wellbore to effect increased well production.

The downhole system, as shown as the SCS 124, locally alters the pressure, temperature, and/or flow rate conditions of the fluid in the wellbore 104 proximate the SCS 124 (e.g., at the base of the wellbore 104). In certain instances, the alteration performed by the SCS 124 can increase or help in increasing fluid flow through the wellbore 104. As described above, the SCS 124 creates a pressure differential within the well 102, for example, particularly within the wellbore 104 the SCS 124 resides in. In some instances, a pressure at the base of the wellbore 104 is a low pressure (e.g., sub-atmospheric or insufficient to overcome the static head and friction losses of the well), so unassisted fluid flow in the wellbore can be slow or stagnant. In these and other instances, the SCS 124 introduced to the wellbore 104 adjacent to the perforations 114 can reduce the pressure in the wellbore 104 near the perforations 114 to induce greater fluid flow from the subterranean zone of interest 110, increase a temperature of the fluid entering the SCS 124 to reduce condensation from limiting production, and increase a pressure in the wellbore 104 uphole of the SCS 124, to increase fluid flow to the terranean surface 106.

The downhole system, as shown as the SCS 124, moves the fluid at a first pressure downhole of the SCS 124 to a second, higher pressure uphole of the SCS 124. The SCS 124 can operate at and maintain a pressure ratio across the SCS 124 between the second, higher uphole pressure and the first, downhole pressure in the wellbore. The pressure ratio of the second pressure to the first pressure can also vary, for example, based on an operating speed of the SCS 124, as described in more detail below. In some instances, the pressure ratio across the SCS 124 is less than 2:1, where a pressure of the fluid uphole of the SCS 124 (i.e., the second, higher pressure) is at or below twice the pressure of the fluid downhole of the SCS 124 (i.e., the first pressure). For example, the pressure ratio across the SCS 124 can be about 1.125:1, 1.5:1, 1.75:1, 2:1, or another pressure ratio between 1:1 and 2:1. In certain instances, the SCS 124 is configured to operate at a pressure ratio of greater than 2:1.

The downhole system, as shown as the SCS 124, can operate in a variety of downhole conditions of the wellbore 104. For example, the initial pressure within the wellbore 104 can vary based on the type of well, depth of the well 102, production flow from the perforations into the wellbore 104, and/or other factors. In some examples, the pressure in the wellbore 104 proximate a bottomhole location is sub-atmospheric, where the pressure in the wellbore 104 is at or below about 14.7 pounds per square inch absolute (psia), or about 101.3 kiloPascal (kPa). The SCS 124 can operate in sub-atmospheric wellbore pressures, for example, at wellbore pressure between 2 psia (13.8 kPa) and 14.7 psia (101.3 kPa). In some examples, the pressure in the wellbore 104 proximate a bottomhole location is much higher than atmospheric, where the pressure in the wellbore 104 is above about 14.7 psia, or about 101.3 kPa. The SCS 124 can operate in above atmospheric wellbore pressures, for example, at wellbore pressure between 14.7 psia (101.3 kPa) and 15,000 psia (103,421 kPa).

An amplifier drive and magnetic bearing controller 150 for a downhole system, shown as the SCS 124 is, in some implementations, located topside to maximize reliability and serviceability. A digital signal processor (DSP) based controller receives the position signals from sensor and/or sensor electronics within the SCS 124 and uses this for input as part of its position control algorithm. This algorithm output is a current command to an amplifier to drive coils of the active bearings within the SCS 124, thus impacting a force on the rotor (details are explained later within the disclosure). This loop typically happens very fast, on the order of 1,000-20,000 times per second depending on the system control requirements. The control system is also capable of interpreting the bearing requirements to estimate forces and fluid pressures in the well. Analog circuit based controllers can also perform this function. Having the DSP or analog circuit based controller topside allows for easy communication, service, and improved up-time for the system, as any issues can be resolved immediately via local or remote support. Downhole electronics are also an option either proximate to the device or at a location more thermally suitable. In a downhole implementation, the electronics are packaged to isolate them from direct contact with the downhole environment. They offer better control options since they don't encounter issues such as long cable delay and response issues.

Figure 2:
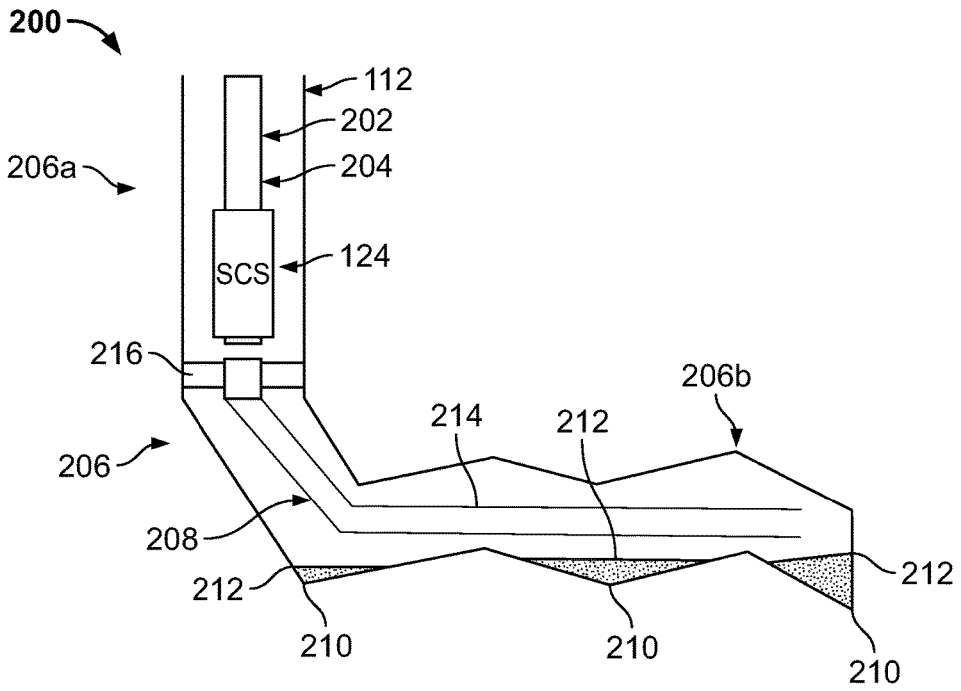
FIG. 2 is a side cross-sectional view of a second example wellbore production system.

FIG. 2 is a side cross-sectional view of an example production well system 200 that can be used with aspects of this disclosure. The production well system 200 is similar to the production well system 100 except for the differences described herein. As illustrated, the SCS 124 sends production fluid towards a topside facility through the production tubing 202. In some implementations, the SCS 124 sends production fluid towards a topside facility through the casing 112. That is, the casing is a wetted surface exposed to the production fluid.

The SCS 124 draws fluid from the cased portion of a wellbore 206. In some implementations, the SCS 124 can draw fluid from a second production string defining a flow passage directly coupled to an inlet of the SCS 124. In some implementations, the SCS 124 can draw fluid from a velocity string 208. Details on the structure and functional aspects of the velocity string 208 are described later within this disclosure.

In the production well system 200, the SCS 124 is supported by a production tube 202 at a discharge end 204 of the SCS 124. In some implementations, a combination packer/hanger can be positioned uphole of the SCS 124 and can provide sealing and support to the SCS 124, the production tubing 202, or both. In such an implementation the combination packer/hanger can seal an annulus defined by the outer surface of the production tube 202 and the inner surface of the casing 112. In some implementations, the combination packer/hanger can be integrated into the SCS 124 and seal an annulus defined by an outer surface of the SCS 124 and the inner surface of the casing 112. While described as singular component, the combination packer/hanger can include a separate packer and a separate hanger. For example, a packer can be positioned to seal the annulus defined by the outer surface of the production tubing 202 and the inner surface of the casing 112 while a hanger can be integrated into the SCS 124 to support the SCS 124 to the casing 112. Alternatively or in addition, the combination packer/hanger, or a discrete packer and/or a discreet hanger, can be positioned downhole of the SCS 124 to provide sealing and/or support.

The wellbore 206 is similar to the wellbore 104 of FIG. 1 except for the differences described herein. The wellbore 206 includes a vertical wellbore section 206*a* and a horizontal wellbore section 206*b*. Vertical wellbore section 206*a* is similar to production well system 100 of FIG. 1, except that the production zones are located within the horizontal wellbore section 206*b*. The production zones can be cased, lined, or uncased. In uncased, or open-hole implementations, perforations may not be necessary in all circumstances. The horizontal wellbore section 206*b* includes several discontinuities 210 that allow liquid 212 to pool during production operations. Liquids can also accumulate in formation cracks or fissures, were gas travels through the formation to the well, and block gas passage, further reducing well production. The gas flow is not strong enough to break the surface tension strength of the liquid that adheres to the walls of the formation, and thus the liquids prevent the gas flowing through the cracks of the formation. If left unchecked, the pooled liquid has the potential to reduce the production rate of the well system 200. As the production rate decreases, a flow velocity of produced gas is reduced as well. This reduction can lead to more liquid production to further reduce gas production rates. While illustrated as a horizontal wellbore section 206*b*, aspects of this disclosure are equally applicable to deviated sections as well, as they have the potential to similarly build up pooled liquid within discontinuities.

The velocity string 208 is positioned downhole of the SCS 124. The velocity string 214 is sized to result in increase in gas flow velocity and a decrease in pressure to maintain the same mass flow rate in comparison to gas flowing through an open wellbore. The smaller the inside diameter of the velocity string, the higher the fluid velocity will be. The longer the velocity string, the longer the wellbore will have higher fluid velocity. However, when the diameter is too small and when the velocity is too long, the friction loss caused by fluids running through surface of the pipe will also increase. Therefore, there is a desired length and diameter of the velocity for a given well conditions and desired flowrates. For constant flow rate, the fluid velocity is inversely proportional to the cross-section area of the velocity pipe. For example, to double the velocity, the cross-sectional area of the velocity string is half of the cross-sectional area of the wellbore. Velocities can be doubled or tripled by adjusting cross-sectional area with little undesired effects. The virtuous cycle will start as long as there are more liquids being carried away than liquids dropping out of the gas stream. For example, in some instances, experimental data shows that the stable gas flow will carry the liquid with it once the superficial gas velocity is greater than twenty feet per second. In some implementations, the velocity string is continuous without apertures along its sidewall. In some instances, apertures can be defined at preset intervals along the string. In such implementations, the flow rate downstream of the aperture will be increased. In this case, the fluid velocity downstream of the aperture will be decreased. The higher flow rate and lower pressure caused by the velocity string increases a vaporization rate of liquid within the wellbore 206. The increased vaporization rate decreases a surface area of the production zone that is blocked by liquid, increasing the mass flow rate of the produced gas. The increased mass flow rate of the produced gas increases the vaporization rate of the liquid, creating a virtuous cycle of removing liquid, and increasing gas production rates.

As illustrated, an annulus defined by an outer surface of the velocity string 214 and an inner surface of the wellbore 206 are fluidically isolated from the vertical wellbore section 206*a* of the wellbore by a packer 216. Isolating the annulus limits the available flow paths between the horizontal wellbore section 206*b* of the wellbore and the SCS 124, forcing production fluid through a flow passage defined by the velocity string 214. In some implementations, the packer 216 can include a hanger to at least partially support the velocity string from the side of the wellbore. While not shown, additional support structures, such as centralizers, can be used to support the velocity string 214 within the horizontal wellbore section 206*b*.

The SCS 124 can also produce an increase in gas flow velocity and a decrease in pressure in comparison to gas flowing through an open wellbore. The higher flow rate and lower pressure caused by the SCS 124 increases a vaporization rate of liquid within the wellbore 206. The increased vaporization rate decreases a surface area of the production zone that is blocked by liquid, increasing the mass flow rate of the produced gas. The increased mass flow rate of the produced gas increases the vaporization rate of the liquid, creating a virtuous cycle of removing liquid, and increasing gas production rates.

The SCS 124 used in conjunction with the velocity string 214 has an amplified effect of vaporizing the pooled liquid than either the velocity string or the SCS 124 alone. Specific compressor sizing and velocity string geometry can be designed for gas production wells on a case-by-case basis depending on production rates, production composition, downhole pressure, and other factors. For example, known variables, such as the reservoir deliverability, the compressor performance, and the wellbore geometry are collected. These three things help determine the flow rate of the well with an SCS 124 installed. Once the flow rate is known the gas velocity can be calculated based on the wellbore geometry and the flowrate. With the gas velocity, efficiency of liquid removal can be determined by either modeling or using experimental data. If the efficiency of removing liquid with the specific gas velocity is not high enough, then the gas velocity can be increased by reducing the inside diameter of the horizontal velocity string 214.

Alternatively or in addition, the SCS 124 increases a temperature of the production fluid as it is produced. The additional heat provided by the SCS 124 helps keep any vaporized liquid in a gaseous or suspended state as it travels up the production tubing 202. In some implementations, the additional heat added by the SCS 124 is a controllable parameter. That is, the speed, size, efficiency, or other parameters of the SCS 124 are designed and/or adjusted to heat the production fluid at a specified temperature.

Figure 3A:
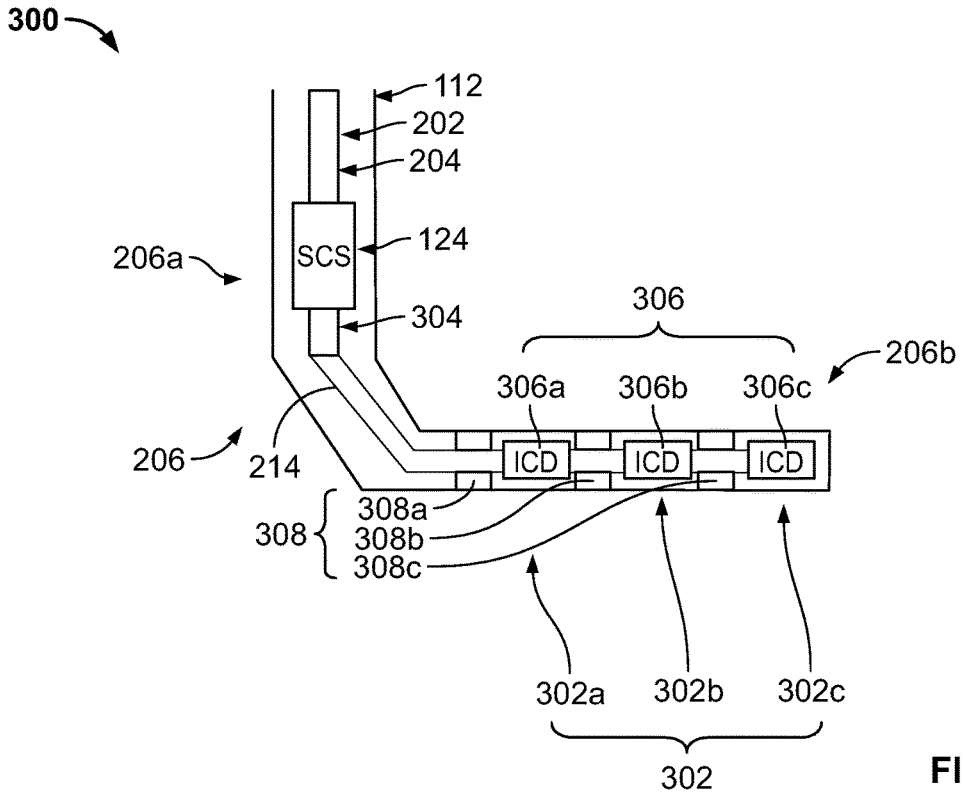
FIGS. 3A-3B are side cross-sectional views of a third and fourth example wellbore production system.

FIG. 3A is a side cross-sectional view of an example production well system 300 that can be used with aspects of this disclosure. The production well system 300 is similar to the production well system 200 except for the differences described herein. As illustrated, a velocity string 214 defines a flow passage directly from the production zones 302 to an inlet 304 of the SCS 124. In some implementations, a second production string can be used in lieu of the velocity string 214.

The production well system 300 also includes several inflow control devices (ICDs) 306. The inflow control devices have an outer housing that defines an inlet flow geometry with a cross-sectional flow area configured to increase a flow velocity of the production fluid. The smaller cross-sectional flow area increases a flow velocity for a given mass flow rate. The increased flow velocity also lowers a pressure in each production zone 302. The combination of increased velocity and lowered pressure, increases a rate of vaporization for liquids within each production zone. In some implementations, the combination of the velocity string 214, the ICD 306 and the SCS 124, increases a vaporization rate of liquids within a production zone more than any one of the velocity string 214, the ICD 306, or the SCS 124, used alone. The ICDs 306 can be passive ICDs with fixed flow geometries (such as a restriction orifice or another velocity string), or can be active ICDs, such as a downhole valve. In instances where downhole valving is used, flowrates and velocities can be regulated for each production zone 302. In instances where such an active system is used, open and/or closed control loops can be used to control the active ICDs.

As illustrated, an annulus defined by an outer surface of the velocity string 214 and an inner surface of the wellbore 206 is fluidically isolated between each of the production zones 302. For example, a first production zone 302*a* is isolated by a first packer 308*a* at a first end of the first production zone, and a second packer 308*b* at a second end of the first production zone 302*a*. A second production zone 302*b* is isolated by the second packer 308*b* at a first end of the second production zone 302*b*, and a third packer 308*c* at a second end of the second production zone 302*b*. A third production zone 302*c* is isolated by the third packer 308*c* at a first end of the third production zone 302*c*. Isolating the individual annular sections of each production zone 302 limits the available flow paths between each production zone 302 and the SCS 124, forcing production fluid through a flow passage defined by the velocity string 214 and the individual ICDs 306. For example, fluid from the first production zone 302*a* can be directed into a first ICD 306*a*, fluid from the second production zone 302*b* can be directed into a second ICD 306*b*, and fluid from the third production zone 302*c* can be directed into the third ICD 306*c*.

In some implementations, the packers 308 can include a support structures to at least partially support the velocity string to the side of the wellbore. In some implementations, the flows from the individual production zones can be comingled within a single velocity string 214. In some implementations, the flows from the individual production zones can be fed into separate, parallel velocity strings. While the illustrated implementation includes three production zones 302 isolated with packers 308, each zone having its own ICD 306, fewer than three (e.g., one or two) or four or more packers 308, production zones 302, and ICDs 306 could be provided without departing from this disclosure. Alternatively or in addition, some production zones may have ICDs 306 fluidically coupled to a velocity string 214 or production tube, while other production zones 302 may be fluidically coupled directly to the velocity string 214 or production tube without additional ICDs 306.

Figure 3B:
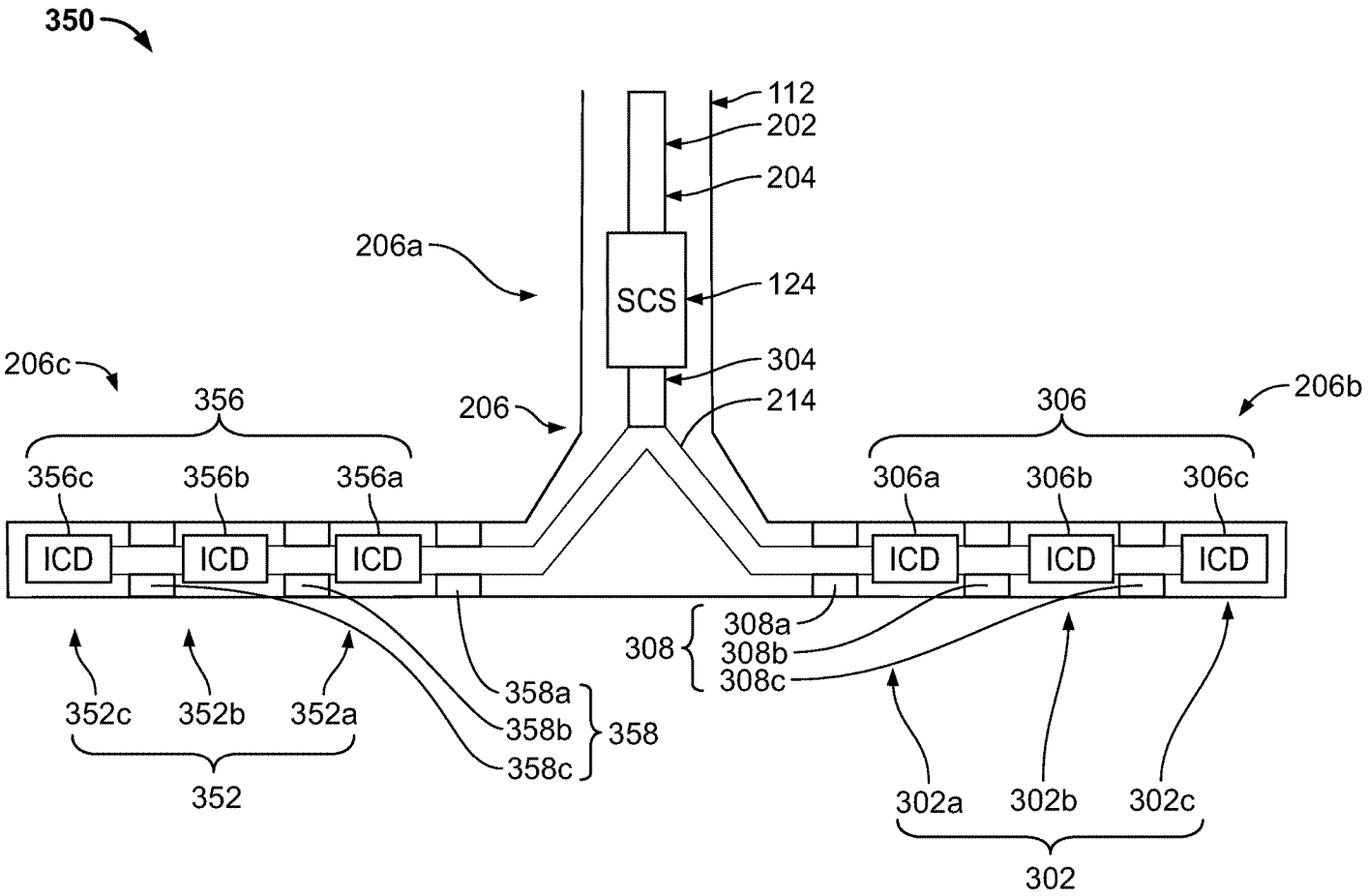

FIG. 3B is a side cross sectional view of an example production well system 350 that can be used with aspects of this disclosure. The well system 350 is similar to well system 300 with the exception of the following differences described herein. The wellbore 206 of system 350 includes a second horizontal section 206*c*. The second horizontal section 206*c* can include a second velocity string 314. The second velocity string 314 can include a second set of ICDs 356, each ICD 356 being adjacent to a production zone 352. Each production zone 352 can be isolated from one another by one or more packers 358. For example, as illustrated in regards to the second horizontal section 206*a*, a first production zone 352*a* is isolated by a first packer 358*a* at a first end of the first production zone, and a second packer 358*b* at a second end of the first production zone 352*a*. A second production zone 352*b* is isolated by the second packer 358*b* at a first end of the second production zone 352*b*, and a third packer 358*c* at a second end of the second production zone 352*b*. A third production zone 352*c* is isolated by the third packer 358*c* at a first end of the third production zone 352*c*. Isolating the individual annular sections of each production zone 352 limits the available flow paths between each production zone 352 and the SCS 124, forcing production fluid through a flow passage defined by the velocity string 314 and the individual ICDs 356. For example, fluid from the first production zone 352*a* can be directed into a first ICD 356*a*, fluid from the second production zone 352*b* can be directed into a second ICD 356*b*, and fluid from the third production zone 352*c* can be directed into the third ICD 356*c*.

EXAMPLE

The following paragraphs describe an example real-world system that is within the scope of this disclosure. It should be understood that the steps taken below are indicative of an example system, and that individual wells will likely have individualized implementations of the subject matter described herein.

Figure 4:
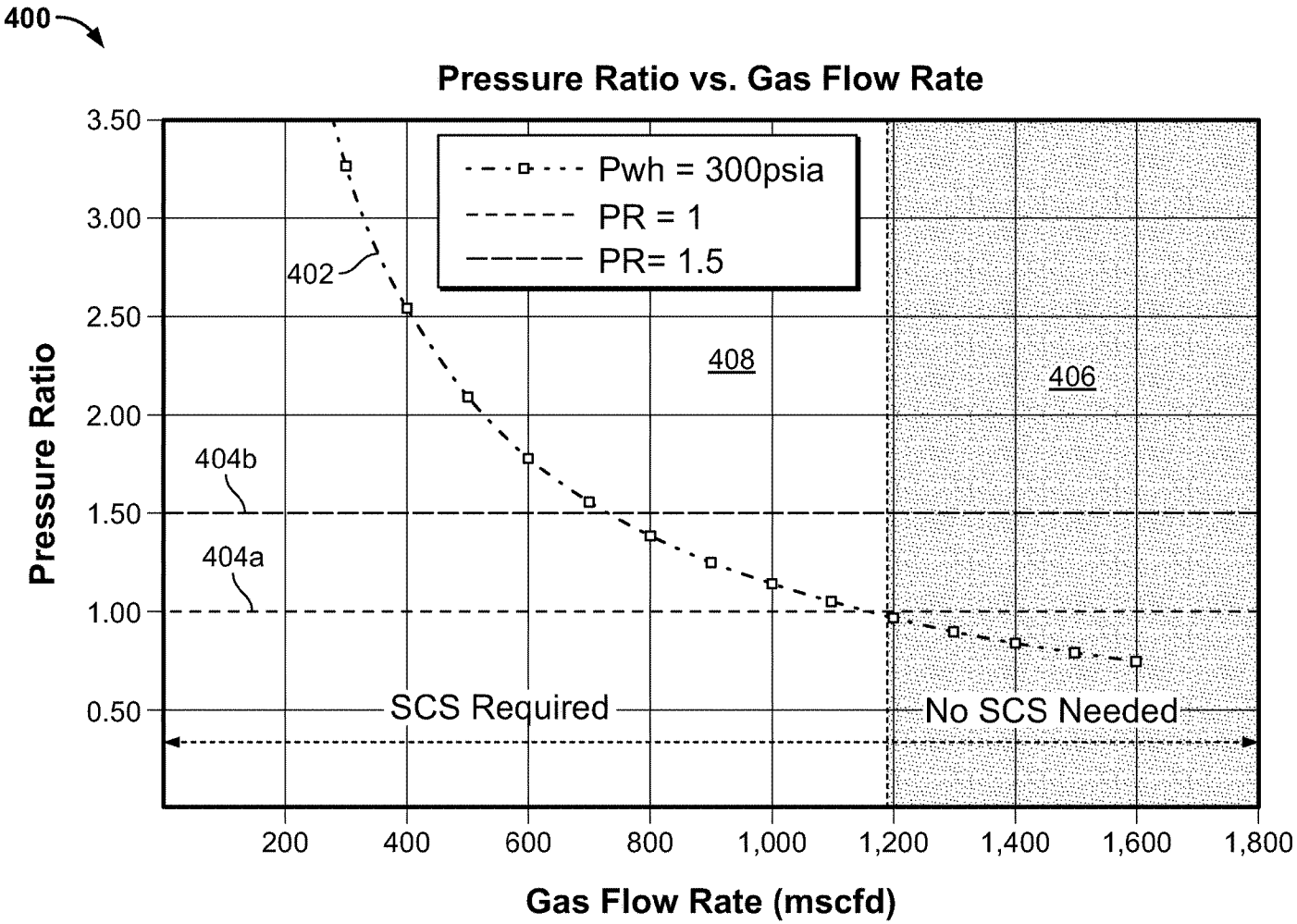
FIG. 4 is a chart illustrating an example operating threshold of a subsurface compressor.

FIG. 4 is a chart 400 plotting an expected gas flow rate (x-axis) versus a pressure ratio (y-axis) provided by the SCS 124. The curved line 402 represents a desired wellhead pressure. In the illustrated case, the desired wellhead pressure is three hundred pounds per square inch. Two pressure ratios are marked by horizontal lines. The first pressure ratio 404*a* is a pressure ratio of 1. That is, no SCS is installed in the case of the first pressure ratio. The second pressure ratio 404*b* is a pressure ration of 1.5. Such a pressure ratio indicates that the discharge of the SCS 124 is at a pressure 50% higher than a pressure at an inlet of the SCS 124. The chart 400 is vertically divided into two sections. On the right-hand side 406 of the 1,200 thousand standard cubic feet per day (mscfd) vertical line, the gas velocity is above 20 feet per second (ft/s), the minimum flow velocity of the gas stream for liquid removal in this example. On the left-hand side 408 of the 1,200 mscfd vertical line, the gas velocity is below 20 ft/s. In this example, liquid cannot be completely removed by the gas stream if the compressor ratio is 1 (no SCS 124 installed). To remove liquid when the flow rate is lower than 1,200 mscfd (left-hand side of the graph 408), an SCS 124 with a certain value of the compression ratio (indicating by the curve) is used to increase the flow rate.

Figure 5:
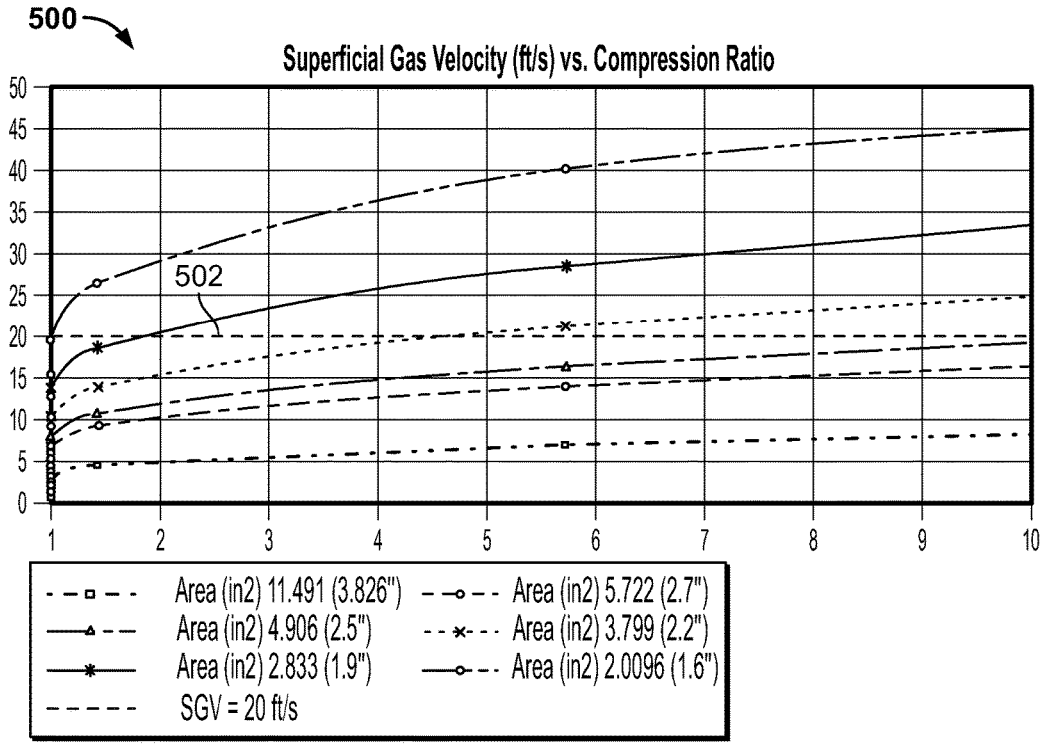
FIG. 5 is a chart illustrating example operating parameters of a wellbore production system under various operating parameters.

FIG. 5 is a chart 500 plotting an expected gas flow velocity (y-axis) versus a compression ratio across the SCS 124. In this example, 20 ft/s is the minimum desired flow velocity, and is marked by a horizontal line 502. The compression ratio of chart 500 is the same as the pressure ratio of chart 400. In the illustrated scenario, the gas velocity is always larger than 20 ft/s for the pipe with 1.6 inch inner diameter (ID). This means that with this velocity string, there is no need of SCS to remove liquid. For the pipe with 1.9 inch ID, the gas velocity will only be above 20 ft/s when the compression ratio is above about 1.8. That means with only velocity string but no SCS, this velocity string cannot remove the liquid completely. For the pipe with the 2.5 inch ID, it will require a SCS with compression ratio larger than 10 to be able to reach 20 ft/s.

Figure 6:
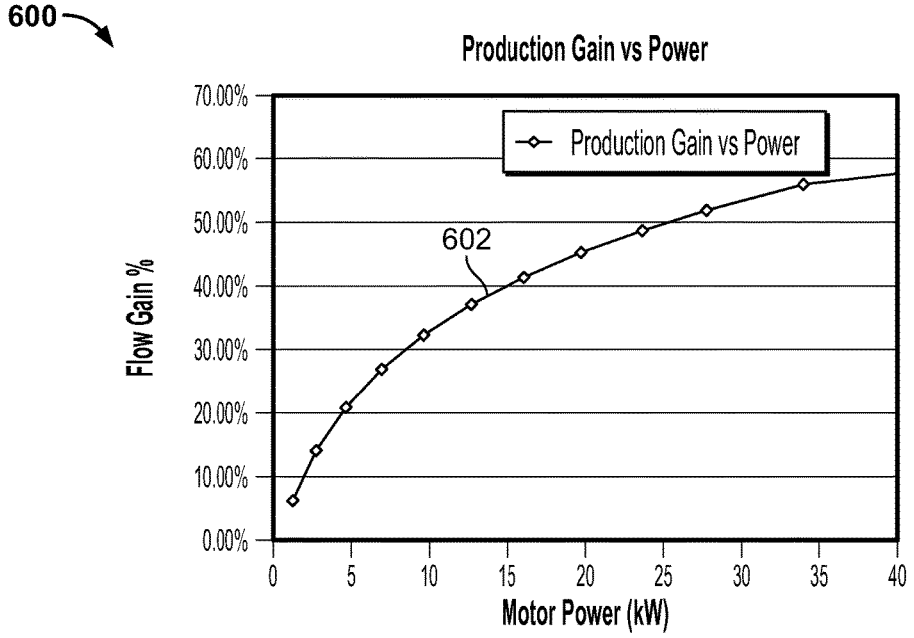
FIG. 6 is a chart illustrating example power requirements vs. production gains for the example well production system.

FIG. 6 is a chart 600 plotting the motor power required (x-axis) versus the expected gain in production (y-axis). A curved line 602 illustrates the power needed for a percentage gain in flow rate. In general, the curved line 602 indicates higher power input will generate higher flow rate; however, there is a diminishing rate of return. The desired flowrate for a given well can be determined by a number of factors in addition to the downhole gas velocity. For example, gas prices and cost of power production can be a factor. The illustrated chart can be created for either a fixed speed motor or a variable speed motor. Based on the chart 600, a 12 kilowatt compressor will increase the gas production of this well by about 37%.

Based on the previously described charts for the example production well, a 2-3/8 inch ID pipe, with no ICD, and a 12 kW compressor were selected. The previously described graphs are merely examples. Similar charts can be made for production gas wells on a case by case basis. During design, other factors can be taken into account and different designs can be selected based on each case. For example, a velocity string with no SCS can be used in some instances. In some instances, an ICD can be used in conjunction with a velocity string, an SCS, or both.

A number of embodiments of the subject matter have been described. Nevertheless, it will be understood that various modifications may be made without departing from the scope described herein. For example, additional SCSs can be used within the production string. In some implementations, heat tracing can be added to sections of the production string to maintain heat and reduce liquid dropout. While described primarily in the context of a land-based system, details of this disclosure can be equally applied to subsea systems. For example, the surface compressor 122 can be a subsea compressor without departing from this disclosure. Accordingly, other embodiments are within the scope of the following claims.

What is claimed is:

1. A well production method comprising:

increasing gas flow velocity within a horizontal wellbore section by an velocity string and a downhole-type compressor;

decreasing a pressure within the horizontal wellbore section by the downhole-type compressor located within a wellbore section fluidically connected to the horizontal wellbore section, the decreased pressure in the horizontal wellbore section being sufficient to at least partially vaporize liquids within the horizontal portion; and decreasing liquid build-up within the horizontal wellbore section in response to the increased gas flow velocity and the decreased pressure of the horizontal wellbore section.

2. The method of claim 1, further comprising increasing a temperature of the gas flow by the downhole-type compressor.

3. The method of claim 2, wherein the increased temperature is sufficient to prevent liquid fallout between a discharge of the downhole-type compressor and a topside facility located at an uphole end of the vertical wellbore section.

4. The method of claim 1, further comprising sizing the downhole-type compressor to set a minimum flow velocity to remove liquids from the horizontal wellbore section.

5. The method of claim 4, further comprising sizing the downhole-type compressor to set a maximum downhole pressure to vaporize liquids in the horizontal wellbore section.

6. The method of claim 5, further comprising sizing the downhole-type compressor to use a specified amount of power to drive the compressor.

7. The method of claim 1, wherein the inflow control device is a first inflow control device, and the horizontal wellbore section is a first horizontal wellbore section, the method further comprising:

increasing a gas flow velocity within a second horizontal wellbore section by a second velocity string and the downhole-type compressor.

8. The method of claim 7, the method further comprising:

increasing a gas flow velocity within a third horizontal wellbore section by a third velocity string and the downhole-type compressor.

9. A wellbore production system comprising:

a production wellbore comprising a vertical portion and a horizontal portion, the vertical portion comprising a first end at a topside facility, the horizontal portion comprising a first end connected to a second end of the vertical portion, and a second end at a distal end of the production wellbore;

a downhole-type compressor located within the wellbore, the downhole-type compressor configured to decrease a pressure on a downhole side of the compressor and increase a pressure on an uphole side of the compressor, the decreased pressure on the downhole side being sufficient to at least partially vaporize liquids within the horizontal portion, the increased pressure on the uphole side being sufficient to flow gas from a compressor discharge to the topside facility;

a production string located within the wellbore; and a velocity string located within the horizontal portion of the wellbore, the velocity string fluidically connected to the production string, the velocity string configured to adjust a gas velocity within the horizontal portion of the wellbore.

10. The wellbore production system of claim 9, wherein the velocity string comprises a flow passage having a cross-sectional flow area that is less than the cross-sectional flow area of the production string.

11. The wellbore production system of claim 9, wherein the velocity string is a first velocity string, wherein the first velocity string is located adjacent to a first production zone, the wellbore production system further comprising;

a first set of packers comprising:

a first packer located on a first end of the first velocity string; and a second packer located on a second end of the first velocity string, the first packer and the second packer configured to fluidically isolate an annulus defined by the first velocity string and a wall of the horizontal portion adjacent to the first production zone, from a remainder of the wellbore; and a second velocity string fluidically connected to the production string, the second velocity string being adjacent to a second production zone.

12. The wellbore production system of claim 11, further comprising;

a third packer located on a second end of the second velocity string, the second packer and the third packer configured to fluidically isolate an annulus defined by the second velocity string and a wall of the horizontal portion adjacent to the second production zone, from a remainder of the wellbore; and a third velocity string fluidically connected to the production string, the third velocity string being positioned on a side of the third packer opposite of the second velocity string, the third velocity string being adjacent to a third production zone.

13. The wellbore production system of claim 9, further comprising a surface compressor fluidically connected to an uphole end of the production tubing, the surface compressor configured to further increase the gas flow velocity.

14. The wellbore production system of claim 13, wherein the surface compressor comprises a subsea compressor.

15. The wellbore production system of claim 9, wherein the horizontal portion is a first horizontal portion, the velocity string is a first velocity string, the system further comprising:

a second horizontal portion comprising a first end connected to the second end of the vertical portion, and a second end at a second distal end of the production wellbore; and a second velocity string located within the second horizontal portion of the wellbore, the second velocity string fluidically connected to the production string, the second velocity string configured to adjust a gas velocity within the horizontal portion of the wellbore.

16. A well production method comprising:

increasing a gas flow velocity within a horizontal wellbore section by a velocity string and a downhole-type compressor;

decreasing a pressure within the horizontal wellbore section by the downhole-type compressor located within a vertical wellbore section fluidically connected to the horizontal wellbore section, the decreased pressure in the horizontal wellbore section being sufficient to at least partially vaporize liquids within the horizontal portion;

decreasing liquid build-up within the horizontal wellbore section in response to the increased gas flow velocity and the decreased pressure of the horizontal wellbore section; and increasing a temperature of the gas flow by the downhole-type compressor, wherein the increased temperature is sufficient to prevent liquid fallout between a discharge of the downhole-type compressor and a topside facility located at an uphole end of the vertical wellbore section.

17. The method of claim 16, further comprising sizing the downhole-type compressor to set a minimum flow velocity to remove liquids from the horizontal section.

18. The method of claim 16, further comprising sizing the downhole-type compressor to set a maximum downhole pressure to vaporize liquids in the horizontal section.

19. The method of claim 16, further comprising sizing the downhole-type compressor to use a specified amount of power to drive the compressor.

20. The method of claim 16, wherein the velocity string is an active velocity string, the method further comprising adjusting a cross-sectional flow area of the active velocity string to adjust the gas velocity of the horizontal wellbore during a gas production operation.

21. The method of claim 16, wherein the velocity string is a first velocity string, and the horizontal wellbore section is a first horizontal wellbore section, the method further comprising:

increasing a gas flow velocity within a second horizontal wellbore section by a second velocity string and the downhole-type compressor.

22. The method of claim 21, wherein the second velocity string is an active velocity string, the method further comprising adjusting a cross-sectional flow area of the active velocity string to adjust the gas velocity of the second horizontal wellbore section during a gas production operation.

23. The method of claim 16, the method further comprising:

increasing a gas flow velocity within a third horizontal wellbore section by a third velocity string and the downhole-type compressor.

* * * * *